United States Patent [19]

Lisiecki

[11] 4,390,121

[45] Jun. 28, 1983

[54] CONTAINER AND BLANK FOR CONSTRUCTING SAME

[75] Inventor: Robert E. Lisiecki, Orchard Lake, Mich.

[73] Assignee: Ex-Cell-O Corporation, Troy, Mich.

[21] Appl. No.: 309,357

[22] Filed: Oct. 7, 1981

[51] Int. Cl.[3] ..... B65D 5/72

[52] U.S. Cl. ..... 229/17 G

[58] Field of Search ..... 229/17 G, 17 R, 7 R

[56] References Cited

U.S. PATENT DOCUMENTS

| | | | |
|---|---|---|---|
| 2,826,349 | 3/1958 | Houland | 229/17 G |
| 2,993,630 | 7/1961 | Cox | 229/17 G |
| 3,167,231 | 1/1965 | Bray | 229/17 G |
| 3,186,621 | 6/1965 | Suensson | 229/17 G |
| 3,217,966 | 11/1965 | Kelly | 229/17 G |
| 3,270,940 | 9/1966 | Egleston | 229/17 G |
| 3,272,425 | 9/1966 | Bendersky | 229/17 G |
| 3,297,227 | 1/1967 | Wallsten | 229/17 G |
| 3,348,755 | 10/1967 | MacEwen | 229/17 G |

FOREIGN PATENT DOCUMENTS

| | | | |
|---|---|---|---|
| 491330 | of 1953 | Canada | 229/17 G |

*Primary Examiner*—Herbert F. Ross

*Attorney, Agent, or Firm*—John P. Moran

[57] ABSTRACT

The drawings illustrate two embodiments of a plastic coated, liquid carrying gable top container, and a blank for forming same, including an easily opened pouring spout by virtue of a slit being formed therein, and a flap integrally formed thereon for protecting the lip of the pouring spout and serving to permit liquid tight sealing of the filled container. In one embodiment, the pouring spout is in the conventional location at one of the folded-in gable end sections. In the other embodiment, the pouring spout is formed as one of the sides of the gable top.

13 Claims, 10 Drawing Figures

CONTAINER AND BLANK FOR CONSTRUCTING SAME

TECHNICAL FIELD

The invention relates generally to a coated paperboard container and, more particularly, to a blank for constructing the container so as to include a folded top end closure of an improved construction.

BACKGROUND ART

Containers for beverages such as milk, cream, other dairy products, juices, and the like are conventionally constructed from thermoplastic coated paperboard. One type of these containers include a top end closure with a folded gable roof ridge for sealing the container and providing a pouring spout when the contents of the container are to be dispersed. Such containers are shown in U.S. Pat. No. 3,270,940.

DISCLOSURE OF THE INVENTION

A general object of the invention is to provide an improved coated paperboard container and a blank for constructing the container including a top end closure comprised of a folded roof and a top seal for sealing the roof, and wherein the construction of the top end closure provides a protected, easy opening pour device independent of the primary top seal.

Another object of the invention is to provide a container top closure arrangement in accordance with the present invention which includes the usual gable panel, and adjacent fold back panels and infold lips, and, additionally, includes a slit formed laterally across the infold lips and protected by a foldable flap formed on the outer edge of the front or spout panel.

A further object of the invention is to provide, as an alternate to the arrangement of the preceding paragraph, a container top closure arrangement which includes a lower closure panel and an upper closure panel on one side thereof having diagonal scores formed on the lower panel and a slit formed laterally across the upper panel and protected by a foldable flap formed on the outer edge of the upper panel.

A still further object of the invention is to provide a container top closure arrangement wherein the seal of the opening means is independent of the primary top seal, thereby eliminating the need for an adhesive feature, as shown and described in U.S. Pat. No. 3,270,940.

Other objects and advantages of the invention will become more apparent when reference is made to the following description and accompanying drawings.

BEST MODE OF CARRYING OUT THE INVENTION

Figure 1:
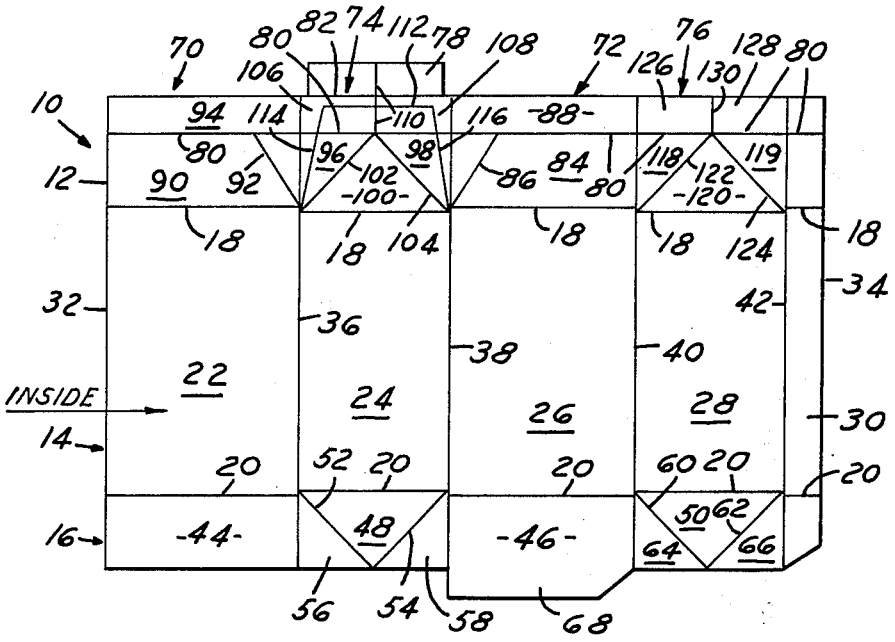
FIG. 1 is a layout view of a plastic coated paperboard container blank embodying the invention.

Referring now to the drawings in greater detail, FIG. 1 illustrates a container blank 10 formed in accordance with the principles of the present invention. The container blank 10 is generally divided into three sections including a top end closure 12, a body portion 14, and a bottom end closure 16. A staggered lower top horizontal score line 18 extends transversely across the container blank 10 and separates the top end closure 12 and the body portion 14. A bottom staggered horizontal score line 20 extends transversely across the container blank 10 and separates the bottom end closure 16 and the body portion 14. The body portion 14 comprises a plurality of integrally connected body panels 22, 24, 26 and 28, a side seam flap 30. The container blank 10 is defined on its longitudinal sides by its edges 32 and 34. The body panels 22, 24, 26 and 28, and the side seam flap 30 are defined by vertical score lines 36, 38, 40 and 42.

The bottom end closure 16 has a pair of external closure panels 44 and 46 which are integral with and extend longitudinally from the body panels 22 and 26, respectively. A pair of substantially triangular closure panels 48 and 50 are an integral part of the flat bottom end closure 16, and they extend longitudinally from the body panels 24 and 28, respectively. The closure panel 48 is defined by the transverse score line 20 and bottom diagonal score lines 52 and 54, and is integrally connected to the external closure panels 44 and 46 by a pair of substantially triangular fold back panels 56 and 58, respectively. The closure panel 50 is defined by the horizontal score line 20 and a pair of bottom diagonal score lines 60 and 62. A pair of substantially triangular fold back panels 64 and 66 integrally connect the closure panel 50 to the external closure panel 46 and the side seam flap 30, respectively. As is set forth in more detail hereinafter, the side seam flap 30 is connected to the external full closure panel 44 so as to place the fold back panel 66 adjacent to the external closure panel 44 in a constructed or erected container. As shown in FIG. 1, the external closure panel 44 is not provided with an extended so-called, tuck-in flap, but the external closure panel 46 is provided with an integral overlap flap 68. The details of the bottom end closure 16 are discussed in detail in U.S. Pat. No. 3,498,524 which issued on Mar. 3, 1970, and U.S. Pat. No. 3,120,335 which issued on Feb. 4, 1964, and these patents are incorporated herein by reference.

The top end closure 12 comprises outer roof panels 70 and 72. The panels 70 and 72 are integrally connected to the upper ends of the body panel members 22 and 26, respectively. A front or spout panel 74 and a back or closure panel 76 are integrally connected to the body panels 24 and 28, respectively. A flap 78 is formed on the outer edge of the spout panel 74 a predetermined amount narrower than the width of the latter. An upper top horizontal score line 80 extends transversely from the blank edge 32 to the blank edge 34, parallel to the horizontal score lines 18 and 20. An additional score line 82 is formed parallel to the score line 80 between the flap 78 and the adjacent spout panel 74.

The outer roof panel 72 is divided into two portions by the horizontal score line 80. A lower closure panel portion 84 is defined by the score lines 40, 38, 80 and 18. An opening assist score line 86 extends substantially from the intersection of the score line 18 and the score line 38 to a point on the score line 80 that is closer to the score line 38 than to the score line 40. An upper closure panel portion 88 of the outer roof panel 72 serves as a sealing panel, as will be explained.

The outer roof panel 70 is divided into two parts by score line 80. The inner part of the roof panel 70 comprises a lower closure panel 90 which is defined by the horizontal score lines 80 and 18, the vertical score line 36 and the edge 32. An opening assist score line 92 extends from the intersection of score lines 18 and 36 to a point on the score line 80. The last mentioned intersection on the score line 80 is closer to the score line 36 than to the edge 32, and it is substantially the same distance from the score line 36 as the opening assist score line 86 is from the score line 38 along the score line 80. The outer roof panel 70 includes an upper closure panel 94 which is integral with the closure panel 90, and it is separated therefrom by the score line 80. The closure panel 94 likewise serves as a sealing panel.

The spout panel 74 includes a pair of fold back panels 96 and 98 connected on opposite sides of a gable panel 100 by diagonal score lines 102 and 104, respectively, the latter extending from the intersections of the horizontal score line 18 and the vertical score lines 36 and 38, respectively, and meeting at the score line 80. The fold back panels 96 and 98 are also connected to the closure panels 90 and 84, respectively, via the respective score lines 36 and 38. A pair of pouring panels or infold lips 106 and 108 are integrally connected to the fold back panels 96 and 98, respectively, and they are defined by the horizontal score lines 36 and 38, and an intermediate vertical gable score line 110. The latter score line 110 continues vertically across the centerline of the flap 78.

A slit 112 is formed laterally across the upper portion of the infold lips 106 and 108, terminating short of the score lines 36 and 38. A pair of score lines 114 and 116 extend from the ends of the slit 112 to the intersections of the horizontal score line 18 and the respective vertical score lines 36 and 38.

The closure panel 76 includes a pair of fold back panels 118 and 119 connected on opposite sides of a gable panel 120 by diagonal score lines 122 and 124, respectively, the latter extending from the intersections of the score line 18 and the vertical score lines 40 and 42, respectively. The fold back panel 118 connects the gable panel 120 to the closure panel 84, while the panel 119 connects the gable panel 120 to the side seam flap 30. A pair of closure panels or infold lips 126 and 128 are connected to the fold back panels 118 and 119, respectively, and they are defined at their lower ends by the score lines 80, and at their outer edges by the respective score lines 40 and 42. The closure panels 126 and 128 are separated from each other by a vertical gable score line 130 which is centrally located between.

Figure 2:
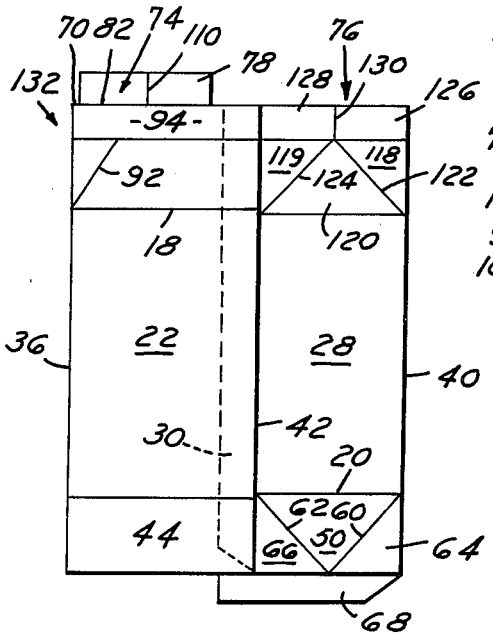
FIG. 2 is a layout view of the outside surface of a container structure after it is side seamed from the container blank illustrated in FIG. 1.

The container blank 10 illustrated in FIG. 1 is formed into a side seam blank as illustrated in FIG. 2, and as designated by the numeral 132. The side seam blank 132 is formed by rotating the body panel 28 and the side seam flap 30 as a unit about the vertical score line 40, and having the inside surfaces of the body panel 28 come into contact with the inside surface of the body panel 26, with the vertical score line 42 positioned parallel to the vertical score line 38, and with the inside surface of the side seam flap 30 contacting the inside surface of the adjacent body panel. The body panel 22 is then rotated about the vertical score line 36 to bring its inside surface into contact with the inside surface of the adjacent body panel. The inside surface of the body panel 22 along the edge 32 comes into contact with the outside surface of the side seam flap 30, and the edge 32 is positioned parallel and aligned with the vertical score line 42. The various members of the top end closure 12 and the bottom end closure 16 will make similar movements, and the container will appear as illustrated in FIG. 2. The container blank 10 is then side seamed or sealed where the inside area of the body panel 22 comes into contact with the outside surface of the side seam flap 30.

Figure 3:
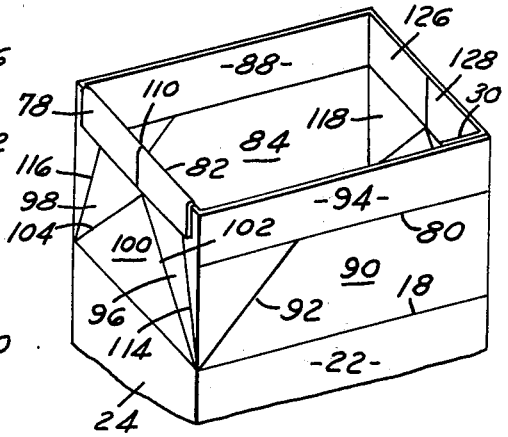
FIG. 3 is a fragmentary perspective view showing the side seamed blank illustrated in FIG. 2 in an open ended tubular arrangement prior to the closing of the top end closure structure of the present invention, but with the extended flap of FIGS. 1 and 2 in a folded down position.

The next step in forming the side seamed blank 132 into a container is illustrated in FIG. 3. The side seam blank 132 is opened up into a tubular condition, after which the flat bottom end closure 16 is formed in a manner well known in the container art, and disclosed in detail in the above cited prior art patents. Generally, in the forming of the flat bottom end closure 16, the closure panels 48 and 50 are moved about the horizontal score line 20 toward the middle of the container. The fold back panels 56/58 and 64/66 rotate about the diagonal score lines 52/54 and 60/62, respectively, with their outside surfaces contacting the outside surfaces of the closure panels 48 and 50. At the same time, the external closure panels 44 and 46 are moving towards each other. The various portions of the flat bottom end closure 16 are then sealed, either by heat or high frequency vibration techniques, to form a liquid tight flat bottom end closure structure.

Once the bottom end closure 16 is formed, the flap 78 is folded around the score line 82 onto the infold lips 106 and 108, covering and sealing the slit 112. If desired, the flap 78 may be folded and sealed during the forming of the side seam blank 132, prior to the forming of the bottom end closure 16.

After the bottom end closure 16 is formed and the flap 78 is folded and sealed, as described above, and a product has been inserted in the container, the various parts of the top end closure 12 are folded about the various score lines in the following manner so as to form the top end structure 12. The spout panel 74 is moved around the horizontal score line 18 over the end of the filled container and towards its center. At the same time, the closure panel 76 is moved toward the middle of the filled container about the horizontal score line 18.

The now outside surfaces (FIG. 3) of the two halves of the flap 78 are thus rotated towards each other about the vertical score line 110, and the closure panels 126 and 128 also have their outside surfaces rotated towards each other about the vertical score line 130. The inside surfaces of the pouring panel 108 and the closure panel 126 will come into contact with the sealing panel 88. The inside surface of the pouring panel 106 and closure panel 128 will come into contact with the sealing panel 94.

Figure 4:
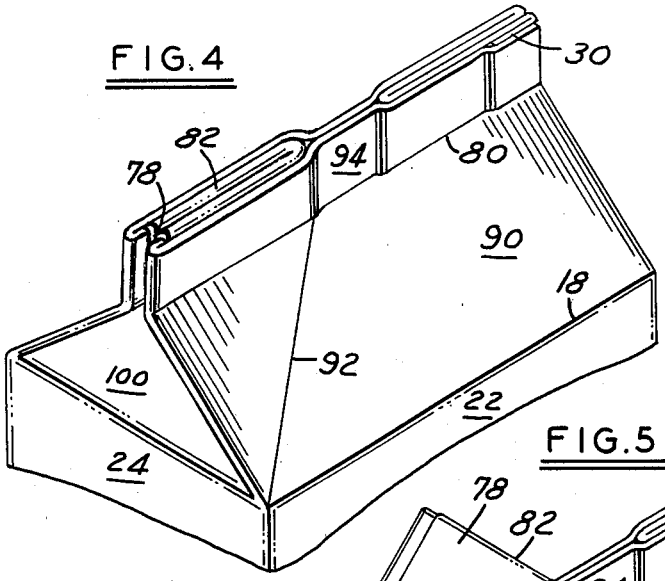
FIG. 4 is a fragmentary perspective view showing the top arrangement illustrated in FIG. 3 after the top end closure structure has been sealed.

As viewed in FIG. 4, the last mentioned top closure elements form a gable top over the body portion 14. The sealing of the last mentioned elements of the top closure 12 is preferably accomplished by a sonic or high frequency vibration sealing means, because such a seal gives a liquid tight seal, and yet is easily opened. The sealing of these various top end closure elements may also be accomplished by other means, such as hot air, if desired.

Figure 5:
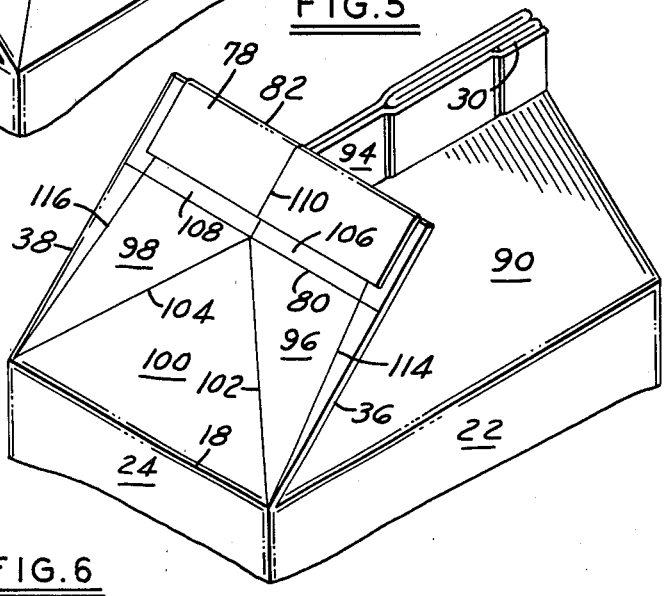
FIG. 5 is a fragmentary perspective view showing the container of FIG. 4 after the primary top seal has been broken.
Figure 6:
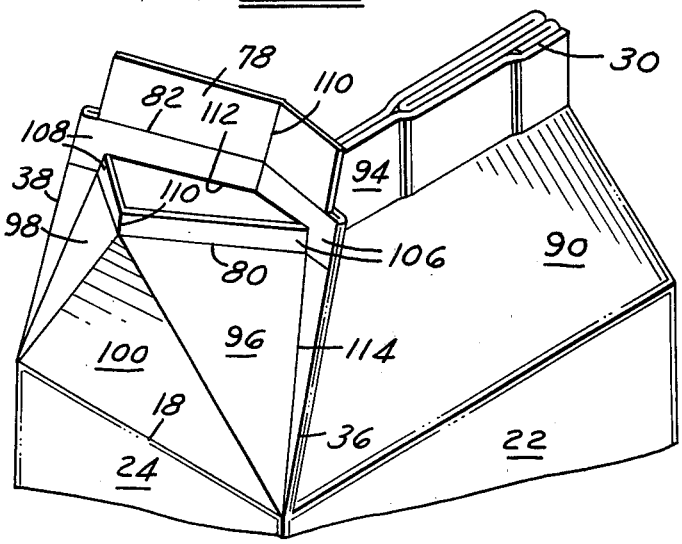
FIG. 6 is a fragmentary perspective view showing the container after the folded over flap has been raised and the pouring spout has been opened.

Opening the gable top end closure into a pouring spout is begun in the well known manner, i.e., the panel portions, consisting on the one side of the fold back panel 96, the infold lip 106 and half of the folded-down flap 78, and on the other side of the fold back panel 98, the infold lip 108 and other half of the folded-down flap 78, are spread apart, bending outwardly along the opening assist score lines 92 and 86, respectively, into the position shown in FIG. 5.

This opening operation is followed by manually lifting up the flap 78 about the score line 82, breaking the seal, and then bending the two sides farther back about the opening assist score lines 86 and 92. Once the lower portions of the infold lips 106 and 108 and the fold back panels 96 and 98 are moved back, so as to project the lower portion of the vertical central score line 110 forward relative thereto, squeezing the edges (scorelines 36 and 38) causes the gable panel 100 to project forward to form a pour spout with the adjacent fold back panels 96 and 98 and the lower portions of infold lips 106 and 108. The pour spout thus formed is, of course, readily closed by being pushed back to its original in-folded position in the well known manner.

Figure 7:
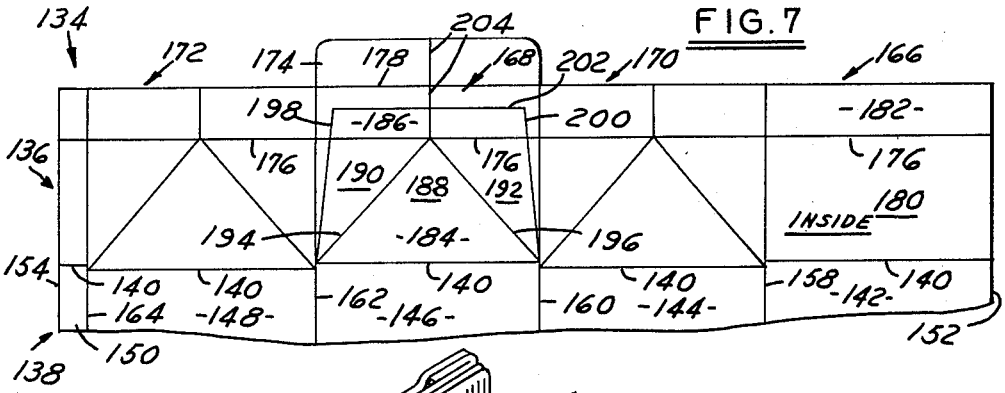
FIG. 7 is a fragmentary layout view of a plastic coated paperboard container blank embodying an alternate form of the invention.

Referring now to FIGS. 7–10, an alternate arrangement to FIGS. 1–6 will be noted, wherein the easy opening pouring spout is formed in conjunction with one of the sides of the gable top, rather than with an end thereof. More specifically, FIG. 7 illustrates a container blank 134 including a top end closure 136 and a body portion 138. The usual staggered lower top horizontal score line 140 extends transversely across the blank 134 and separates the top end closure 136 and the body portion 138. The body portion comprises four integrally connected body panels 142, 144, 146 and 148, and a side seam flap 150. The container blank 134 is defined on its longitudinal sides by its edges 152 and 154. The body panels 142, 144, 146 and 148, and the side seam flap 156 are defined by vertical score lines 158, 160, 162 and 164.

The top end closure 136 comprises outer roof panels 166 and 168. The panels 166 and 168 are connected integrally to the upper ends of the body panel members 142 and 146, respectively. End panels 170 and 172 are integrally connected to the body panels 144 and 148, respectively. A flap 174 is formed on the outer edge of the panel 168, substantially as wide as the latter. An upper top horizontal score line 176 extends transversely from the blank edge 152 to the blank edge 154, parallel to the horizontal score line 140. An additional score line 178 is formed parallel to the score line 140 between the flap 174 and the adjacent outer roof panel 168.

While the outer roof panel 166 is divided by the score line 176 into an unscored lower closure panel portion 180 and an unscored upper closure panel portion 182, the outer roof panel 168 comprises a lower closure panel portion 184 and an upper closure panel portion 186, each of which is formed to include means for opening the container, as will now be explained.

The lower closure panel 184 is divided into three substantially triangular fold-out panel portions 188, 190 and 192 by diagonal score lines 194 and 196 extending from the intersections of the horizontal score line 140 and the vertical score lines 162 and 160, respectively, and meeting at the score line 176. The result is that the intermediate substantially triangular fold-out panel 188 is flanked by triangular panels 190 and 192.

Two other score lines 198 and 200 are formed to extend upwardly from the same intersections at a predetermined small angle with respect to the vertical score lines 162 and 160, across the panel portions 190 and 192, respectively, and thence across the score line 176 to predetermined points on the upper closure panel 186. A slit 202 is formed laterally across the upper portion of the upper closure panel 186, between the ends of the score lines 198 and 200. A vertical score line 204 is formed across the centerline of each of the upper closure panel portion 186 and the flap 174, meeting the score line 176 at the juncture of the diagonal score lines 194 and 196.

The end panels 170 and 172 are each comparable to closure panel 76 of FIG. 1 with respect to the score lines formed thereon for folding the respective ends inwardly in accordance with the conventional gable top configuration.

Figure 8:
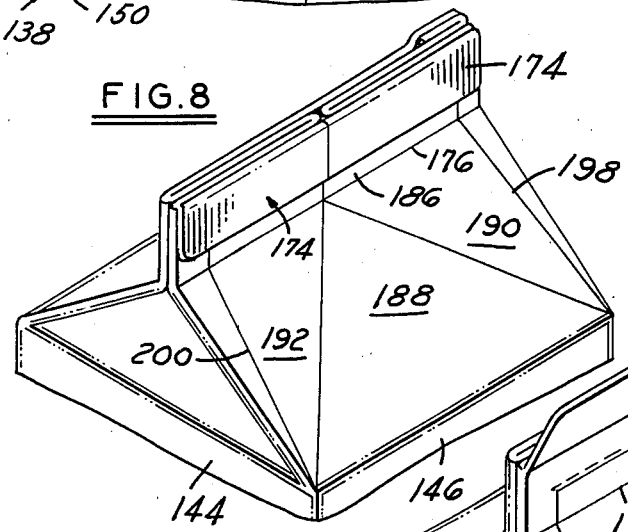
FIG. 8 is a fragmentary perspective view showing the blank of FIG. 7 after the top end closure structure has been sealed.

Once the flap 174 has been folded down over the slit 202 and sealed onto the upper closure panel portion 186, folding and sealing of the blank 134 into a gable top container as shown in FIG. 8 is accomplished in the same manner as described above relative to FIGS. 1–4. If desired, the flap 174 may be folded and sealed during the forming of the side seam blank, prior to the forming of the bottom end closure.

Figure 9:
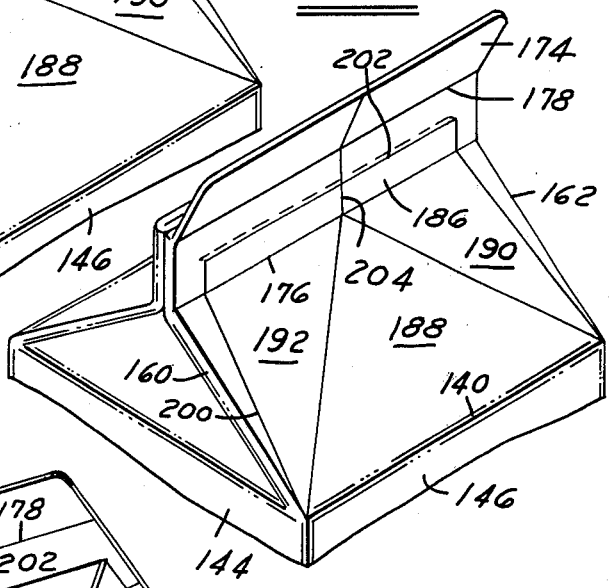
FIG. 9 is a fragmentary perspective view showing the container of FIG. 8 after the seal has been broken and the folded over flap has been raised.
Figure 10:
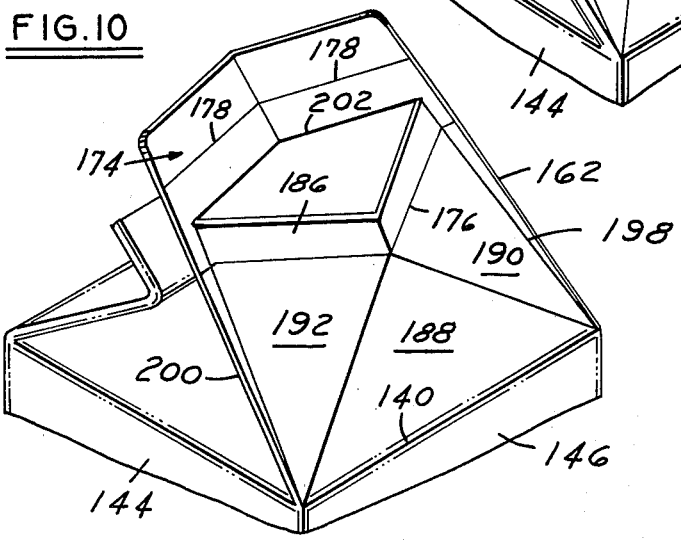
FIG. 10 is a fragmentary perspective view showing the container of FIG. 9 after the pouring spout has been opened.

Opening of the gable top outer roof panel 168 into a pouring spout is begun by first lifting the flap 174 as shown in FIG. 9. Thereafter, squeezing the edges (scorelines 160 and 162) of the panel 168 causes the panel portion 188 to project forward, along with the associated panel portions 190 and 192, and the portions of the upper closure panel 186 framed by the slit 202, the lower end of the score line 204, and the score lines 176, 198 and 200, to form a pour spout as shown in FIG. 10. As may be noted, the edge of the slit 202 forms the edge of the pouring spout.

INDUSTRIAL APPLICABILITY

It should be apparent that the invention provides two embodiments of plastic coated paperboard containers, each having a pouring spout which is easily opened, by virtue of having a lateral slit formed therein, but nevertheless, is protected and tightly sealed so as to prevent leakage by virtue of having a folded-over flap formed as an extension of the top portion which forms the pouring spout, wherein the primary liquid tight seal of the package may be made independently of the seal of the pouring means.

It should also be apparent that both embodiments of the invention are adaptable to either a square or a rectangular container.

While but two embodiments of the invention have been shown and described, other modifications thereof are possible.

The embodiments of the invention in which an exclusive property or privilege is claimed are defined as follows:

1. A plastic coated paperboard blank for a container, said blank comprising four bottom closure panels, four side panels, a pair of lower top closure panels connected to alternate said side panels, a pair of upper top closure panels terminating in aligned edges connected to said lower top closure panels, a pair of substantially triangular gable panels connected to the other alternate said side panels, a pair of substantially triangular fold-back panels flanking each of said gable panels, a pair of infold lips terminating substantially along said aligned edges connected to each of said pair of fold-back panels, a flap connected to a selected one of the four panels consisting of said pair of upper closure panels and said pair of panels each bearing a pair of infold lips, and a lateral slit formed across said selected one of the four panels for a distance beneath said flap less than the full width of said flap, and said flap having a height extending outward from said aligned edges sufficient for the flap to cover said lateral slit when folded down thereon.

2. The blank described in claim 1, wherein said flap and said slit are formed in conjunction with one of said two pairs of infold lips.

3. The blank described in claim 1, wherein said flap and said slit are formed in conjunction with one of said pair of upper closure panels, and a vertical score line is formed across the centerline of said upper closure panel and said flap.

4. The blank described in claim 2, wherein said one of said two pairs of infold lips is the pair positioned between said pair of upper closure panels.

5. The blank described in claim 3, wherein said one of said pair of upper closure panels is the one between said two pairs of infold lips.

6. The blank described in claim 2, and a score line formed to extend downwardly from each end of said slit across the lower portion of one of said two pairs of infold lips and across said adjacent pair of fold-back panels to the base of said flanked gable panel.

7. The blank described in claim 3, wherein said lower closure panel adjacent said one of said pair of upper closure panels is formed to include an intermediate triangular fold-out panel flanked by two triangular fold-out panels.

8. The blank described in claim 7, and a score line formed to extend downwardly from each end of said slit across the lower portion of said one of said pair of upper closure panels and across said two triangular fold-out panels to the base of said flanked intermediate triangular fold-out panel.

9. A gable top, liquid carrying container including four side panels, a bottom closure arrangement connected to the lower ends of said side panels, and gable top closure panel sections connected to the upper ends of said respective side panels, said gable top closure arrangement comprising means formed on one of said gable top closure panel sections for providing a pouring spout, said means including a slit formed for a distance across an upper portion of said one of said panel sections less than the full width thereof, and a flap formed on the upper edge of said one of said panel sections and folded over said slit and sealed directly onto said one of said panel sections for preventing leakage through said slit until said flap is raised and said pouring spout is opened to permit pouring of a liquid over the lower edge of said slit.

10. The gable top, liquid carrying container described in claim 9, wherein said one of said panel sections includes a substantially triangular gable panel, a pair of substantially triangular fold-back panels flanking said gable panel, and a pair of infold lips connected to said pair of fold-back panels as extensions thereof, said flap being connected to said pair of infold lips as a folded-over extension thereof, and said slit being formed laterally across a predetermined portion of said infold lips and adapted to be covered by said flap when said gable top closure panel sections are in the closed mode and to serve as the edge of said pouring spout when said gable top closure panel sections are opened and said flap is raised.

11. The gable top, liquid carrying container described in claim 9, wherein said one of said panel sections includes a lower closure panel formed to include an intermediate triangular fold-out panel flanked by two triangular fold-out panels, and an upper closure panel, said slit being formed laterally across a portion of said upper closure panel and said flap being connected as a folded-over extension of said upper closure panel, and a vertical score line formed across said upper closure panel and said flap for cooperation with said fold-out panels when said one of said panel sections is opened into a pouring spout, said lower edge of said slit serving as the edge of said pouring spout.

12. The gable top, liquid carrying container described in claim 10, and a score line formed to extend downwardly from each end of said slit across the lower portion of one of said two pair of infold lips and across said adjacent pair of fold-back panels to the base of said flanked gable panel.

13. The gable top, liquid carrying container described in claim 11, and a score line formed to extend downwardly from each end of said slit across the lower portion of said one of said pair of upper closure panels and across said two triangular fold-out panels to the base of said flanked intermediate triangular fold-out panel.

* * * * *